US005966896A

United States Patent [19]

Tylman

[11] Patent Number: 5,966,896

[45] Date of Patent: Oct. 19, 1999

[54] CAST HONEYCOMB PANEL SYSTEM

[76] Inventor: Vincent R. Tylman, P.O. Box 373, 95 Tanglewood Dr., Lake Oswego, Oreg. 97035

[21] Appl. No.: 09/008,030

[22] Filed: Jan. 16, 1998

[51] Int. Cl.[6] ..... E04C 2/34

[52] U.S. Cl. ..... 52/793.1; 52/309.12; 52/592.6

[58] Field of Search ..... 52/576, 577, 309.12, 52/592.4, 592.1, 592.6, 793.1, 794.1

[56] References Cited

U.S. PATENT DOCUMENTS

| | | | |
|---|---|---|---|
| 2,849,758 | 9/1958 | Plumley et al. | 52/793.1 X |
| 3,529,389 | 9/1970 | Wilkins | 52/793.1 X |
| 4,150,175 | 4/1979 | Huettemann | 52/793.1 X |
| 4,614,071 | 9/1986 | Sams et al. . | |
| 4,833,855 | 5/1989 | Winter, IV . | |
| 4,841,702 | 6/1989 | Huettemann . | |
| 4,856,248 | 8/1989 | Larson et al. . | |
| 4,942,702 | 7/1990 | Lemasson . | |
| 5,038,541 | 8/1991 | Gibbar, Jr. . | |
| 5,172,532 | 12/1992 | Gibbar, Jr. . | |
| 5,209,037 | 5/1993 | Kennedy et al. . | |
| 5,305,568 | 4/1994 | Beckerman . | |
| 5,465,542 | 11/1995 | Terry . | |
| 5,497,589 | 3/1996 | Porter . | |

*Primary Examiner*—Creighton Smith
*Attorney, Agent, or Firm*—Fasth Law Offices; Rolf Fasth

[57] ABSTRACT

The structural honeycomb panel system comprises a honeycomb structure that has a hollow tongue section disposed at one side of the honeycomb structure and a groove member disposed at an opposite side of the honeycomb structure. The hollow tongue section has an elongate groove defined therein so that the elongate groove is parallel with the groove member. A plurality of openings are defined in the honeycomb structure and a filler material is disposed in the openings. A system of panels may be assembled so that the tongue sections are inserted into the groove sections. Each panel may also have corresponding tongue and groove side sections that are easily assembled.

12 Claims, 3 Drawing Sheets

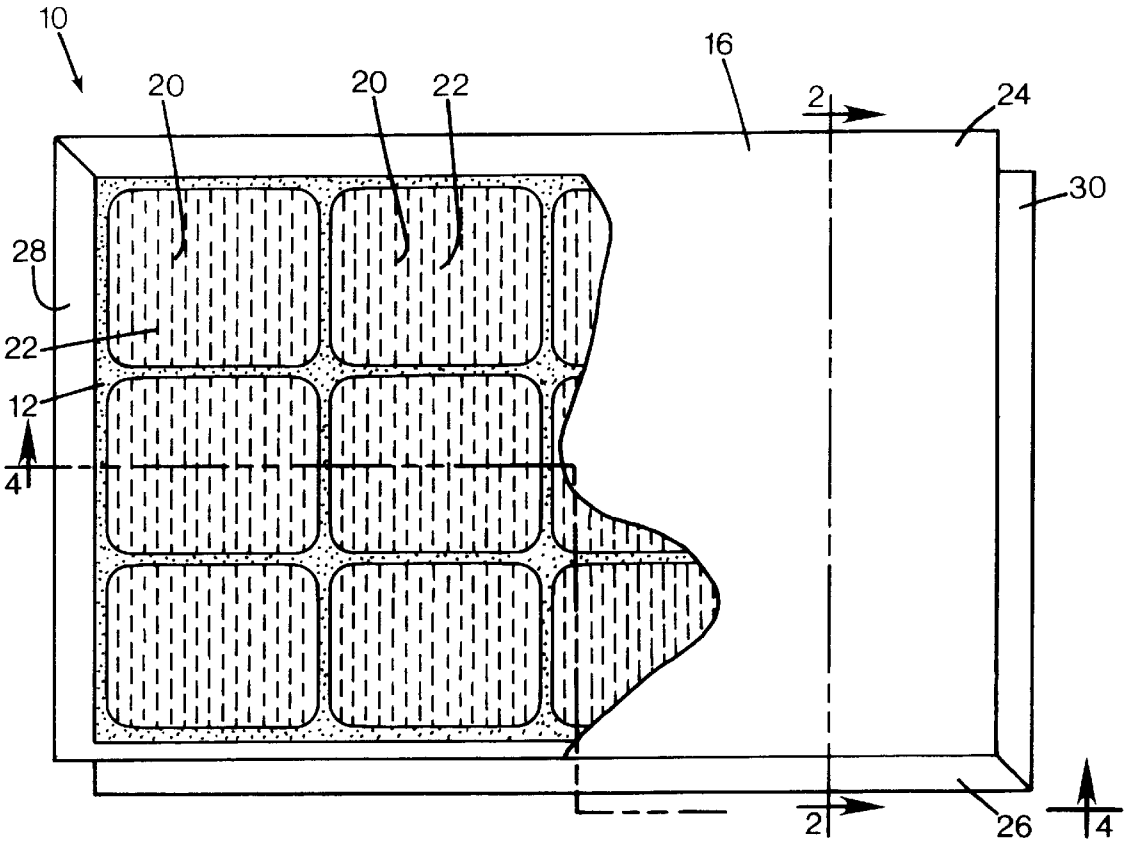
FIG. 1
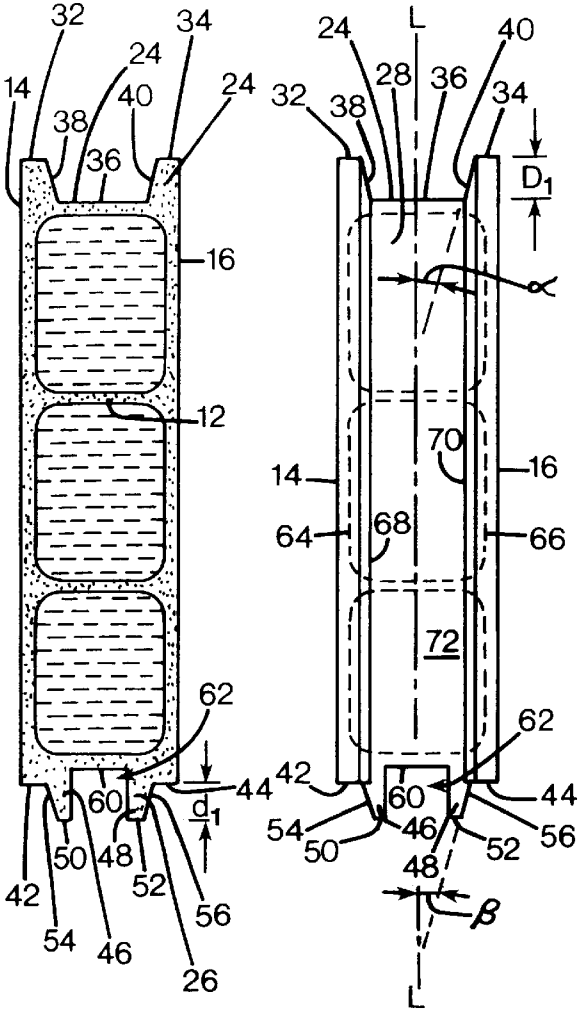
FIG. 2
FIG. 6

CAST HONEYCOMB PANEL SYSTEM

TECHNICAL FIELD

The invention relates to a structural cast honeycomb panel system for efficient construction of building structures.

BACKGROUND INFORMATION AND SUMMARY OF THE INVENTION

There is an increasing demand for effective replacements of wood as a building material due to the diminishing wood resources and relatively slow and labor-intensive building techniques. Many attempts to develop lightweight cementitious building systems have been made. However, the prior art methods have been either too complicated or too expensive to use. Other drawbacks with the prior art technologies are that they are cumbersome to handle, and the finished building systems often lack aesthetic appeal.

Additionally, there is an increasing need to safely and efficiently extend electrical wires and reinforcements inside the wall units without sacrificing the aesthetic appeal or structural integrity of the overall building structure.

The structural honeycomb panel system according to the present invention satisfies the above listed needs and requirements. The panel system comprises a honeycomb structure that has a hollow tongue section disposed on two sides of the honeycomb structure and a groove member disposed at opposite sides of the honeycomb structure. The hollow tongue section has an elongate groove defined therein so that the elongate groove is parallel with the groove member. A plurality of rectangular shaped openings are defined in the honeycomb structure and a foam plastic material may be disposed inside the openings. A system of panels may be assembled so that the tongue sections of a honeycomb panel are inserted into the groove sections of adjacent honeycomb panels. Also, electrical wires and reinforcement members may be placed inside the hollow tongue sections without reducing the strength and aesthetic appeal of the building system.

BRIEF DESCRIPTION OF THE DRAWINGS

FIG. 1 is a perspective sectional view of the cast honeycomb panel of the present invention;

FIG. 2 is a cross-sectional view of the honeycomb panel along line 2—2 of FIG. 1;

FIG. 6 is an end view of the honeycomb panel system showing a groove side section.

DETAILED DESCRIPTION

Figure 7:
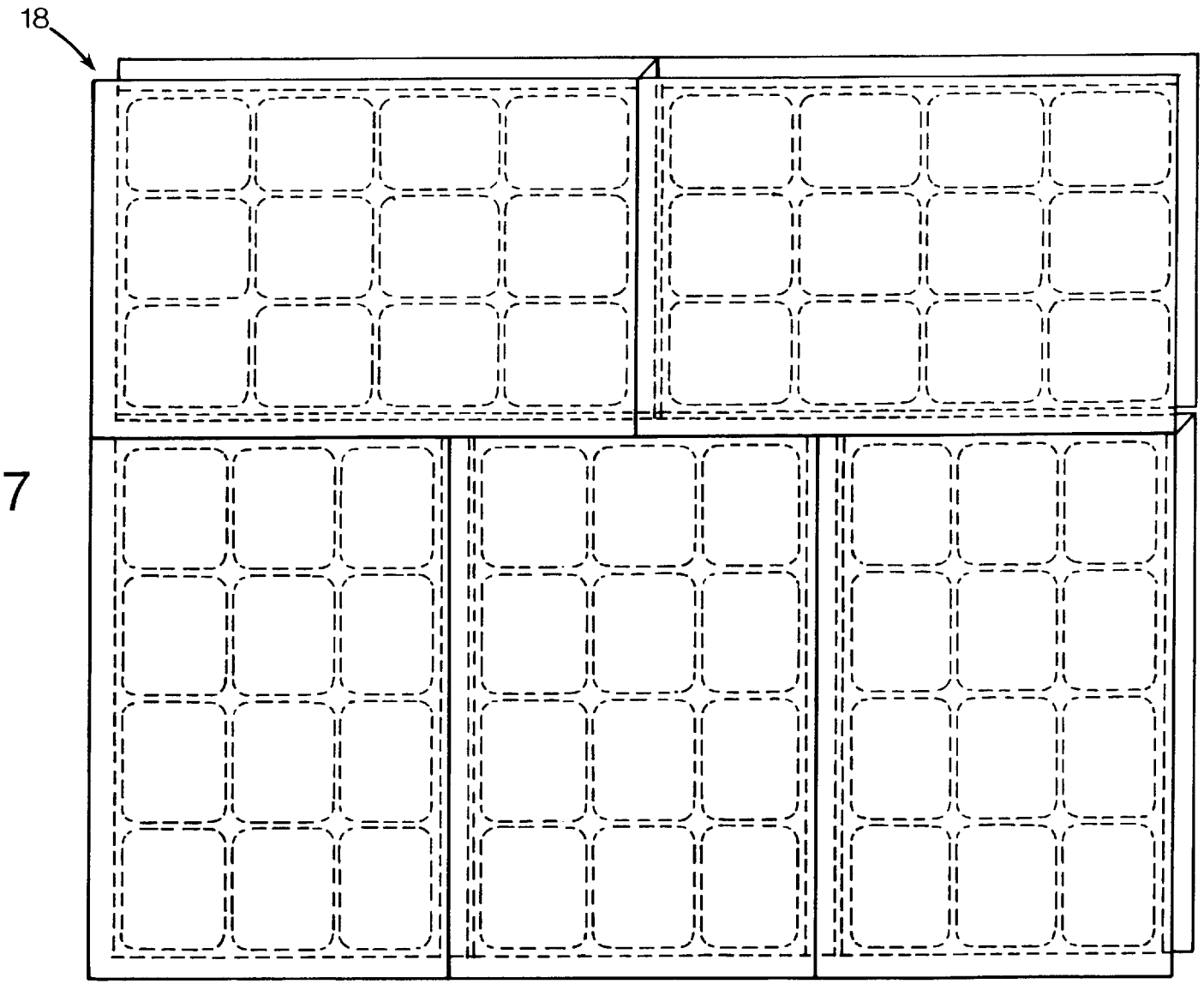
FIG. 7 is a perspective view of a honeycomb panel system of the present invention.

With reference to FIGS. 1–6, the cast honeycomb panel 10 of the present invention comprises a homogeneous honeycomb structure 12 that is integral with two opposite exterior skins 14, 16. As best shown in FIG. 7, the honeycomb panels may be stacked on top of one another and placed in a side-by-side manner to form a wall panel system 18.

The homogeneous honeycomb structure 12 may be made of a cementitious material such as magnesium oxyphosphate cement or magnesium oxychloride cement. Other suitable cementitious and non-cementitious materials may also be used. The structure 12 defines a plurality of lateral openings 20 therein that are filled with a filler material 22 such as Styrofoam, urethane foam or any other suitable and lightweight insulative material. As seen in FIG. 1, the openings 20 are preferably rectangular shaped with round corners. Of course, the openings 20 may have other suitable shapes such as hexagonal or round shapes.

Figure 3:
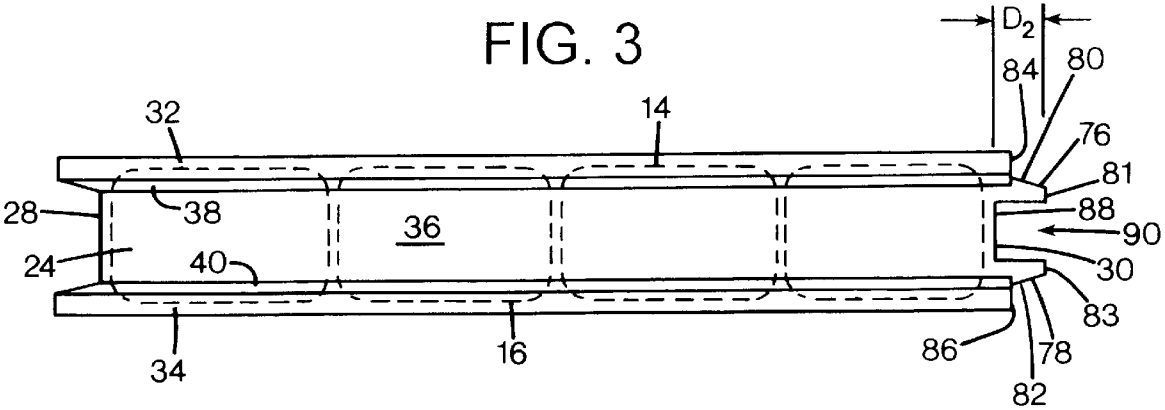
FIG. 3 is a top view of the honeycomb panel shown in FIG. 1.
Figure 4:
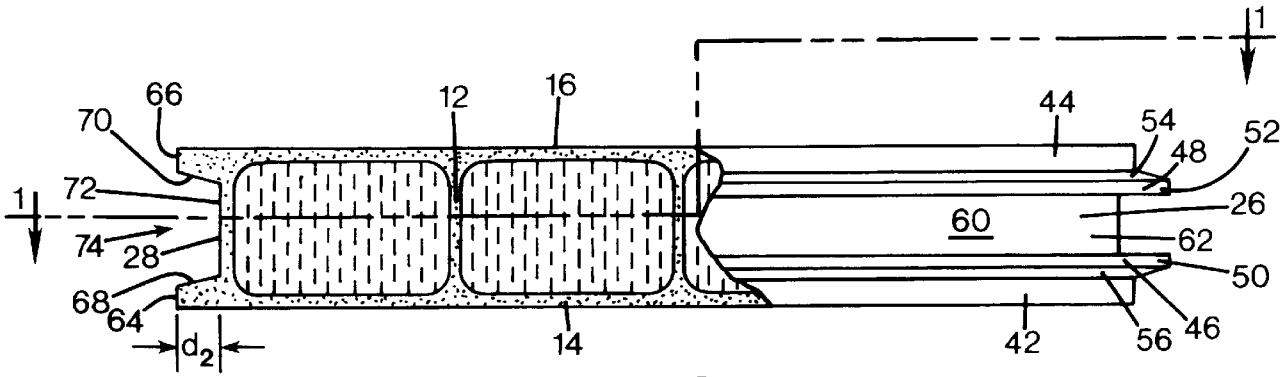
FIG. 4 is a bottom view of the honeycomb panel along line 4—4 of FIG. 1.

The panel 10 has an upper groove section 24 (FIG. 3) and a lower tongue section 26 (FIGS. 3 and 4). The panel 10 also has a side groove section 28 (FIG. 6) and a side tongue section 30 (FIG. 5), as described in detail below.

As best seen in FIGS. 2, 3 and 6, the upper groove section 24 has two flat support surfaces 32, 34 that are disposed on each side of a flat bottom surface 36. Slanted side walls 38, 40, respectively, extend between the bottom surface 36 and the support surfaces 32, 34. The support surfaces 32, 34 are disposed at a distance (D1) from the bottom surface 36 and form an angle alpha that is, preferably, between 10–15 degrees relative to the longitudinal axis L. More preferably, the angle alpha is about 12 degrees. It is to be understood that other angles may be used.

As best seen in FIGS. 2, 4 and 6, the lower tongue section 26 includes flat support surfaces 42, 44. A pair of tongue portions 46, 48, respectively, extend away from the support surfaces 42, 44. At the outer ends of the tongue portions, the outer surfaces 50, 52 are disposed. The outer surfaces 50, 52 are located a distance (d1) from the support surfaces 42, 44. An important feature is that the distance d1 is less than the distance D1. Slanted side surfaces 54, 56, respectively, extend from the support surfaces 42, 44 to the outer surfaces 50, 52. The side surfaces 54, 56 form an angle beta that is between about 10–20 degrees relative to the longitudinal axis. More preferably, the angle beta is about 15 degrees. Other angles may also be used. A flat bottom surface 60 is disposed between the outer surfaces 50, 52 at a distance therefrom so that a groove 62 is defined therein so that the lower tongue portion 26 has a hollow interior.

Similar to the upper groove section 24, the side groove section 28, best seen in FIGS. 4 and 6, has vertical support surfaces 64, 66 and slanted side sections 68, 70 that extend from the support surfaces 64, 66 down to a bottom side surface 72 to that an elongate cavity 74 is formed therein. The vertical support surfaces 64, 66 are disposed a distance d2 from the bottom side surface 72.

Figure 5:
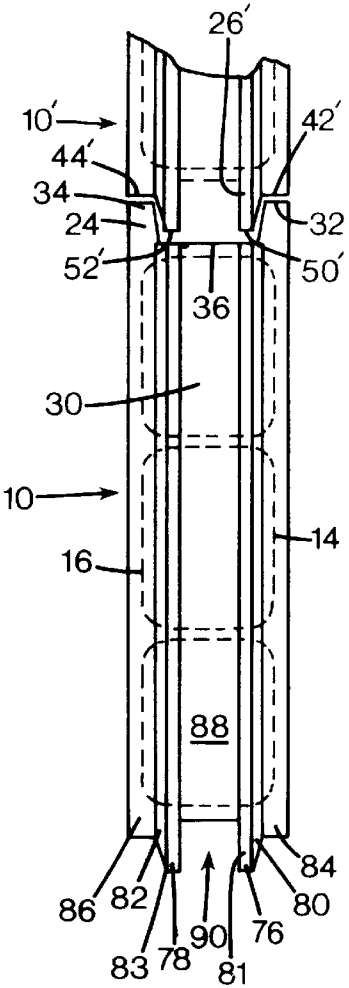
FIG. 5 is an end view of the honeycomb panel showing a tongue side section and a second honeycomb panel partially assembled with an upper tongue section.

Similar to the lower tongue section 26, the side tongue section 30, best seen in FIGS. 3 and 5, has protruding tongue members 76, 78 that each have slanting outer side surfaces 80, 82, respectively, that extend from outer surfaces 81, 83 to vertical support surfaces 84, 86. A flat bottom surface 88 is disposed between the tongue members 76, 78 so that an elongate cavity 90 is formed therein. The bottom surface 88 is disposed a distance D2 from the outer surfaces 81, 83.

An important feature of the present invention is that another identical or different sized panel 10' (see FIG. 5) may be stacked on top of the panel 10 so that the groove section 24 receives a tongue section 26'. The tongue section 26' is identical to the tongue section 26. It is important to note that the support surfaces 32, 34 are engaging the support surfaces 42', 44' of the tongue section 26' and that the outer surfaces 50', 52' are not in contact with the bottom surface 36 because the distance d1 is less than the distance D1. This difference in the distances permits the transfer of compressive stress loads from one honeycomb panel to an adjacent honeycomb panel along the outside skins 14, 16 of the honeycomb panels and prevents any damage to the interior honeycomb structure 12. The outside skins 14, 16 of the panels are preferably the primary load-carrying members of the honeycomb panels. This is an important feature because if the tongue portions of the panels were allowed to press against the bottom surface of the grooves, there would be relatively little support for compressive loads between the panels.

As mentioned above, the angle alpha is slightly greater than the angle beta so that the tongue section 26' may be loosely disposed inside the groove section 24 and that the tongue section is more tightly fit inside the groove when the tongue section 26' is further inserted into the groove section 24. The initial loose fit between the tongue section 26' and the groove section 24 makes it easier to assemble the honeycomb panels to one another.

In the preferred embodiment, the outer skin surfaces 14, 16 are made of the same material and are integral with the internal honeycomb structure 12. This means there is no bond between the internal honeycomb structure 12 and the outer skins 14, 16. This feature is possible because the cementitious material used can be cast by using a lost mold technique. The first half of the structure 12 may be made by using interior mold blocks made of the filler material 22, that are held in place by jigs so that the cementitious material that is cast around the mold blocks forms one half of exact shape of the honeycomb structure desired. The interior mold blocks may be made of a styrofoam, urethane foam or any other lightweight insulative material. The jig or jigs are then removed and the remaining casting material is added to the mold. It is to be understood that the interior mold blocks may be individual blocks or an assembly of blocks that are held together by small columns of the same material such as a foam material. It is also contemplated to use an injection molding process for very high production volumes to reduce labor costs. The above-mentioned molding process provides good design flexibility. For example, by chamfering or filleting the corners of the interior blocks, the interior surfaces of the structure may be made to perfectly blend with each other. In addition, the interior structure may be tailored exactly to the desired engineering specification. By adjusting the thickness of the exterior skins of the segments or the thickness and/or shape of the interior honeycomb walls, the strength of the entire panel may be suitably increased at the points of highest stress. In this way, although the segments may have the same exterior dimensions, the interior structure may be conveniently adjusted to the stress loads of the specific application.

As mentioned above, the preferred embodiment of the honeycomb structure 12 and the skin surfaces 14, 16 may be made of magnesium oxyphosphate cement. This material is not only highly fire retardant while providing a high insulative value but the material has also the property of being able to chemically bond to itself when cold cast. In other words, the material will bond to itself when cast or poured onto a fully cured piece of the same material. This important characteristic of the material allows for a two step casting process that provides a homogenous material. More specifically, during the first pour, the internal mold blocks are held in place by the jig and the lower half of the honeycomb structure is cast. The material sets in about ten to twenty minutes at which time the jig may be removed and the top half of the segment is subsequently cast. Thus, the bond line is at the centerline of the segment. It is to be understood that the segment may also be cast in a single pour by using a different design of a jig. For example, a single pour technique may require the filling of the jig-pin holes after the foam-holding fixture is removed. The fact that the casting material has a very short curing time allows for rapid turnover of molds that greatly reduces tooling costs.

Magnesium oxychloride cement material provides many of the same advantages as magnesium oxyphosphate cement materials. Also, the molding process of the present invention may also use certain types of Portland cement-based materials with some modifications to the process due to different curing requirements.

While the present invention has been described in accordance with preferred compositions and embodiments, it is to be understood that certain substitutions and alterations may be made thereto without departing from the spirit and scope of the following claims.

I claim:

1. A structural honeycomb panel, comprising:

a honeycomb structure made of a cementitious material, the honeycomb structure having a hollow tongue section disposed at one side of the honeycomb structure and a groove member disposed at an opposite side of the honeycomb structure, the hollow tongue section having an elongate groove defined therein, the elongate groove being parallel to the groove member;

a plurality of openings defined in the honeycomb structure;

a filler material disposed inside the openings; and an outer surface member integrally attached to the honeycomb structure to enclose the filler material between the honeycomb structure and the outer surface member, the elongate groove of the hollow tongue section having a first depth and the groove member having a second depth, the first depth being less than the second depth.

2. The structural honeycomb panel according to claim 1 wherein the honeycomb structure further comprises a hollow tongue side section disposed at one side of the honeycomb structure and a groove side member disposed at an opposite side of the honeycomb structure, the hollow tongue side section has an elongate groove defined therein, the elongate groove of the hollow tongue side section is substantially parallel to the groove side member, the elongate groove of the hollow tongue side section is substantially perpendicular to the elongate groove of the hollow tongue section.

3. A structural honeycomb panel, comprising:

a honeycomb structure made of a cementitious material, the honeycomb structure having a hollow tongue section disposed at one side of the honeycomb structure and a groove member disposed at an opposite side of the honeycomb structure, the hollow tongue section having an elongate groove defined therein, the elongate groove being parallel to the groove member;

a plurality of openings defined in the honeycomb structure:

a filler material disposed inside the openings;

an outer surface member integrally attached to the honeycomb structure to enclose the filler material between the honeycomb structure and the outer surface member, the honeycomb structure being made of a magnesium oxyphogphate cement material.

4. The structural honeycomb panel according to claim 1 wherein honeycomb structure defines a plurality of openings that are filled with a insulative material.

5. The structural honeycomb panel according to claim 1 wherein honeycomb structure defines a plurality of openings that are filled with a urethane material.

6. The structural honeycomb panel according to claim 3 wherein the groove member has a slanted surface forming a first angle with a longitudinal axis of the honeycomb panel and the elongate groove of the hollow tongue section has a slanted surface portion forming a second angle with the longitudinal axis, the second angle is greater than the first angle.

7. The structural honeycomb panel according to claim 6 wherein the second angle is about three degrees greater than the first angle.

8. The structural honeycomb panel according to claim 2 wherein the hollow tongue section has an end portion that is immediately adjacent to an end portion of the hollow tongue side section.

9. A structural honeycomb panel system comprising:

a first honeycomb structure having a first hollow tongue section disposed at one side of the first honeycomb structure and a first groove member disposed at an opposite side of the first honeycomb structure, the first hollow tongue section having a first elongate groove defined therein;

a plurality of first openings defined in the first honeycomb structure;

a first filler material disposed inside the first openings;

a second honeycomb structure having a second hollow tongue section disposed at one side of the second honeycomb structure and a second groove member disposed at an opposite side of the second honeycomb structure, the second hollow tongue section having a second elongate groove defined therein;

a plurality of second openings defined in the second honeycomb structure;

a second filler material disposed inside the second openings;

the second hollow tongue section being disposed inside the first groove member of the first honeycomb structures;

the first and second honeycomb structure being made of a magnesium oxyphosphate cement material; and the first elongate groove of the first hollow tongue section having a tongue depth and the first groove member having a groove depth, the tongue death being less than the groove depth.

10. The structural honeycomb panel system according to claim 9 wherein the second hollow tongue section has a second elongate groove defined therein, the second elongate groove has a second depth, the first groove member of the first honeycomb structure has a first depth, the first depth is greater than the second depth so that the second hollow tongue section is remote from a bottom surface of the first groove member when the second hollow tongue section is disposed inside the first groove member.

11. A method of constructing a honeycomb panel system, the method comprising the steps of;

providing a first honeycomb structure made of a cementitious material, the first honeycomb structure having a first hollow tongue section disposed at one side of the first honeycomb structure and a first groove member disposed at an opposite side of the first honeycomb structure, providing a plurality of first openings defined in the first honeycomb structure and providing a first filler material disposed inside the first openings;

providing a second honeycomb structure made of a cementitious material, the second honeycomb structure having a second hollow tongue section disposed at one side of the second honeycomb structure and a second groove member disposed at an opposite side of the second honeycomb structure, providing a plurality of second openings defined in the second honeycomb structure and providing a second filler material disposed inside the second openings; and placing the first hollow tongue section inside the second groove member, the first hollow tongue section having an elongate groove having a first depth and the second groove member having a second depth, the first depth being less than the second depth so that the first depth of the first hollow tongue section supports the second groove member.

12. The method according to claim 11 wherein the method further comprises the steps of:

providing a third honeycomb structure made of a cementitious material, the third honeycomb structure having a third hollow tongue side section disposed at one side of the third honeycomb structure and a third groove side member disposed at an opposite side of the third honeycomb structure, the third honeycomb structure having a third hollow tongue section that is parallel to the third hollow tongue side section;

providing the first honeycomb structure with a first tongue side section that is perpendicular to the first hollow tongue section; and placing the first tongue side section into the third groove side section so that the first tongue section is aligned with the third tongue section.

* * * * *